US009751675B2

(12) United States Patent
Murray

(10) Patent No.: US 9,751,675 B2
(45) Date of Patent: Sep. 5, 2017

(54) METHOD OF MANUFACTURING A POUCH WITH A SEAL STRESS DISPLACEMENT LAYER

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days.

(21) Appl. No.: 14/940,463

(22) Filed: Nov. 13, 2015

(65) Prior Publication Data

US 2016/0152392 A1 Jun. 2, 2016

Related U.S. Application Data

(60) Provisional application No. 62/079,172, filed on Nov. 13, 2014.

(51) Int. Cl.

| | |
|---|---|
| ***B65D 30/00*** | (2006.01) |
| ***B65D 75/52*** | (2006.01) |
| ***B65D 75/58*** | (2006.01) |

(52) U.S. Cl.

CPC ..... *B65D 75/52* (2013.01); *B65D 75/5883* (2013.01); *B65D 2575/586* (2013.01)

(58) Field of Classification Search

CPC .... B65D 33/02; B65D 75/52; B65D 75/5883; B65D 2575/586

USPC ..... 383/104, 119, 107, 108, 906

See application file for complete search history.

(56) References Cited

U.S. PATENT DOCUMENTS

| | | | | |
|---|---|---|---|---|
| 1,479,134 A * | 1/1924 | Guinzburg | ..... | A45D 33/005 383/119 |
| 3,263,848 A * | 8/1966 | Zackheim | ..... | A61J 9/005 128/DIG. 24 |
| 3,554,434 A * | 1/1971 | Anderson | ..... | B65D 33/02 383/104 |

FOREIGN PATENT DOCUMENTS

| | | | |
|---|---|---|---|
| JP | 06122456 A | * | 5/1994 |
| JP | 2000142716 A | * | 5/2000 |
| JP | 2001213445 A | * | 8/2001 |
| JP | 2001270533 A | * | 10/2001 |
| JP | 2005239237 A | * | 9/2005 |

OTHER PUBLICATIONS

Machine translation of the description of JP 06122456 A.*
Machine translation of the description of JP 2000142716 A.*
Machine translation of the description of JP 2005239237 A.*

* cited by examiner

*Primary Examiner* — Jes F Pascua
(74) *Attorney, Agent, or Firm* — Dinsmore & Shohl LLP

(57) ABSTRACT

A pouch and method of making a pouch having configured to displace stress from an inner peripheral edge of a seal is provided. The pouch includes a pouch body sealed along its peripheral edge so as to define a panel. The pouch includes an outer strip. The outer strip is mounted to both sides of the panel, and a distal edge portion of both sides of the strip extends inwardly towards the center of the pouch body so as to extend beyond the inner peripheral edge of the panel. The side edges of the strip overlap the inner peripheral edge of the seal.

8 Claims, 6 Drawing Sheets

METHOD OF MANUFACTURING A POUCH WITH A SEAL STRESS DISPLACEMENT LAYER

CROSS-REFERENCE TO RELATED APPLICATIONS

This application claims priority of U.S. Provisional Application 62/079,172 filed Nov. 13, 2014, the contents of which are incorporated herein by reference.

TECHNICAL FIELD

A flexible pouch having an outer layer configured to displace stress from an inner peripheral edge of a seam and a method of making a flexible pouch filled with a carbonated beverage are provided.

BACKGROUND OF THE INVENTION

Flexible pouches are currently known and used in the art, and are illustratively shown in FIGS. 1 and 2. Such flexible pouches have a pouch body formed by a sheet/sheets of laminate material sealed together to form a seam defining an inner peripheral edge of the pouch body. The sheets are sealed together so as to remain intact when the pouch is filled, and may also be configured to withstand a predetermined amount of external pressure associated with customary handling or occurrences, such as an incidental dropping of the pouch and the like. A fitment is mounted to the pouch body and sealed between the front and back sheets of material.

In instances where the pouch is filled with a carbonated beverage such as beer, or soda the dissolved carbon dioxide is released into the head space of the pouch when the fluid warms up to ambient temperature, substantially increasing the pressure of the head space of the pouch which in turn increases pressure on the seal surrounding the fitment. The increased pressure may lead to failure of the seal. Accordingly, it remains desirable to have a pouch wherein the stress of an expanding pouch body is directed away from the internal peripheral edge so as to maintain the integrity of the seam.

SUMMARY OF THE INVENTION

A pouch having a layer configured to displace stress from an inner peripheral edge of a seam, and a method of making a pouch filled with a carbonated beverage are provided. The pouch includes a pouch body. The pouch body may be formed from a sheet/sheets of flexible material. The pouch body is defined by a pair of sheets spaced apart from each other so as to form a front sheet and a back sheet. The edges of the front and back sheets are sealed together forming a panel having an outer peripheral edge which is exposed to the environment and an inner peripheral edge which is disposed within the pouch body.

The pouch includes a fitment providing access to the content of the pouch body, or may have a weakened section which may be punctured by a sharp end of a straw. The pouch includes an outer strip. The outer strip is mounted to both sides of the panel, and a distal edge portion of both sides of the strip extends inwardly towards the center of the pouch body, overlapping the inner peripheral edge of the seal. In the event of fluid expansion within the pouch body, the stress of the expansion is diverted away from the inner peripheral edge of the seal and towards the distal side edges of the strip. Thus the strip displaces some of the stress on the inner peripheral edge so as to preserve the seal in the event the pouch body expands outwardly.

A method of making a pouch filled with a carbonated beverage includes the step of providing a pouch having a pouch body. The pouch body includes a sealed edge with an opening for receiving a fitment. The method proceeds to the step of sealing the fitment into the opening. The method includes the step of applying a strip of material onto both sides of the sealed edge. The pouch body may be seal extending along the peripheral edge of the pouch body so as to form a panel, wherein the panel includes an inner peripheral edge opposite an outer peripheral edge. The inner peripheral edge is in fluid communication with the pouch body. The outer peripheral edge exposed to the environment. The method may further include the step of applying a strip of material over the entire panel, wherein the strip of material covers both sides of the panel, and wherein the strip of material extends towards the center of the pouch body, past the inner peripheral edge of the panel. The method may further include the step of providing an air channel along the panel, wherein the air channel is disposed along the sides of the pouch body and generally bisects the panel along its axial length.

BRIEF DESCRIPTION OF THE DRAWING

A better understanding of the pouch and method of making the pouch will be had upon reference to the following detailed description when read in conjunction with the accompanying drawing wherein like reference characters refer to like parts throughout the several views and in which.

DETAILED DESCRIPTION OF THE INVENTION

A pouch having a layer configured to displace stress from an inner peripheral edge of a seal is provided. The pouch includes a pouch body. The pouch body is defined by a pair of sheets spaced apart from each other so as to form a front sheet and a back sheet. The edges of the front and back sheets are sealed together forming a panel having an outer peripheral edge which is exposed to the environment and an inner peripheral edge which is disposed within the pouch body.

The pouch includes an outer layer. The outer layer is a strip of material. The strip is mounted to both sides of the panel, and a distal edge portion of both sides of the strip extends inwardly towards the center of the pouch body so as to extend beyond the inner peripheral edge of the panel. The side edges of the strip overlap the inner peripheral edge of the seal.

In the event of fluid expansion within the pouch body, the stress of the expansion is diverted away from the inner peripheral edge of the seal and towards the distal side edges of the strip. Thus the strip displaces some of the stress on the inner peripheral edge so as to preserve the seal in the event the pouch body expands outwardly.

A method of making a pouch filled with a carbonated beverage is also provided. The method includes the step of providing a pouch having a pouch body. The pouch body includes a sealed edge with an opening for receiving a fitment. The method includes the step of sealing the fitment into the opening. The method includes the step of applying a strip of material onto both sides of the sealed edge. The pouch body may be sealed along the peripheral edge of the pouch body so as to form a panel, wherein the panel includes an inner peripheral edge opposite an outer peripheral edge. The inner peripheral edge is in fluid communication with the pouch body. The outer peripheral edge exposed to the environment.

The method may further include the step of applying a strip of material over the entire panel, wherein the strip of material covers both sides of the panel, and wherein the strip of material extends towards the center of the pouch body, past the inner peripheral edge of the panel. The method may further include the step of providing an air channel along the panel, wherein the air channel is disposed along the sides of the pouch body and generally bisects the panel along its axial length. The strip may be removed or left on.

Figure 1:
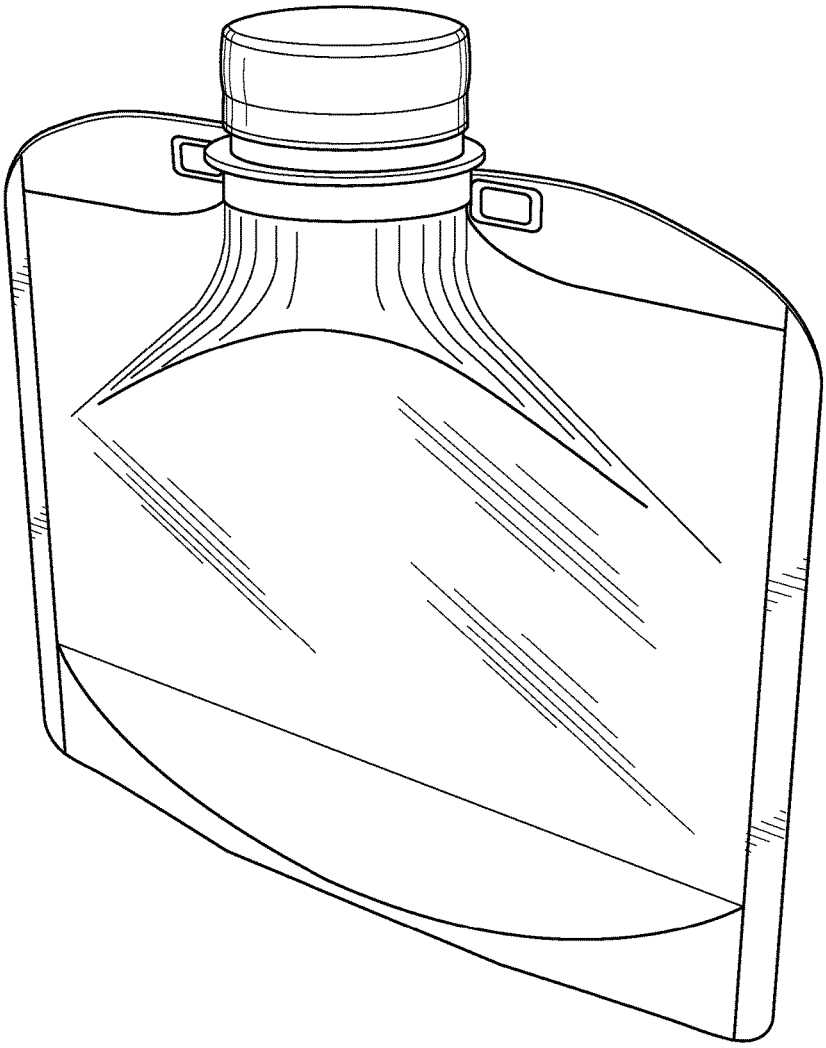
FIG. 1 Prior Art
FIG. 1 is a perspective view of a prior art self-standing pouch.
Figure 2:
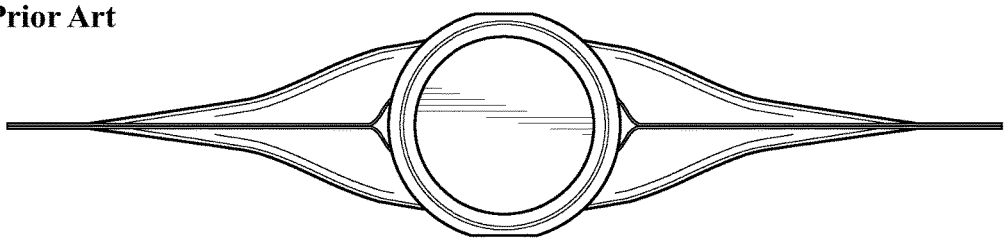
FIG. 2 Prior Art
FIG. 2 is a top-down view of the pouch shown in FIG. 1.
Figure 3:
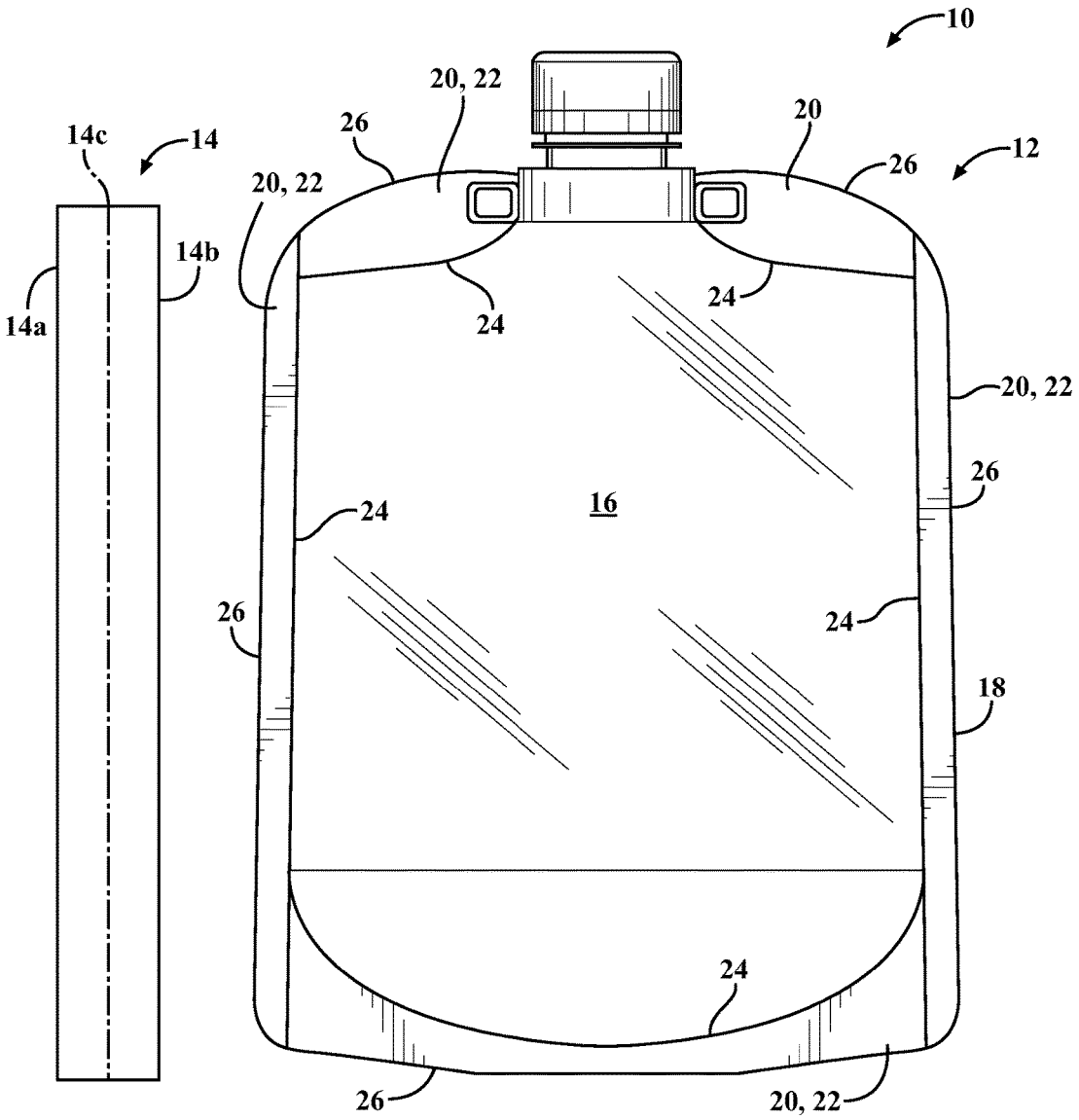
FIG. 3 is an exploded view of the pouch showing the pouch body and the strip.

With reference now to FIG. 3 an exploded view of the pouch 10 is provided. The pouch 10 includes a pouch body 12 and an outer layer 14. The outer layer is a strip 14 of material. The pouch body 12 is formed by a first sheet of material 16 and a second sheet of material 18. The sheets of material 16, 18 may come from a common roll of preprinted material of extruded or laminate layers. The material is typically a three, or four, or five or more gauge material or multiple laminations of material or the like. The outer layer is usually preprinted. Alternatively, a portion of the material may be not printed, i.e. translucent, in order to view the contents contained therein. The pouch 10 may be formed by more than one type of material.

The choice of sheet layer material is non-limiting, and is influenced by factors such as the product contained in the pouch 10, the shape of the pouch 10, or the intended use of the pouch 10. One example of a laminate material structure includes at least one layer of virgin polyethylene terephthalate (PET), at least one layer of aluminum foil and another layer such as EVOH, PET, polyethylene or nylon or the like. Another type of laminate material structure may also include a metalized foil paper layer laminated to a cast polypropylene layer and another layer of PET, polyethylene or EVOH. There may be a fourth layer of nylon. Similarly, the laminate structure may include a cast polypropylene (CPP) layer, a polyethylene (PET) layer, a foil (AL) layer, a nylon (ONO) layer and another CPP layer. Another structure is the use of nylon, foil, nylon and cast polypropylene (ONO/AL/ONO/CPP) or CPP/NY/AL/CPP, or PET/AL/NYLON/CPP, or ONO/AL/COEX-ONO-LDPE.

Figure 4:
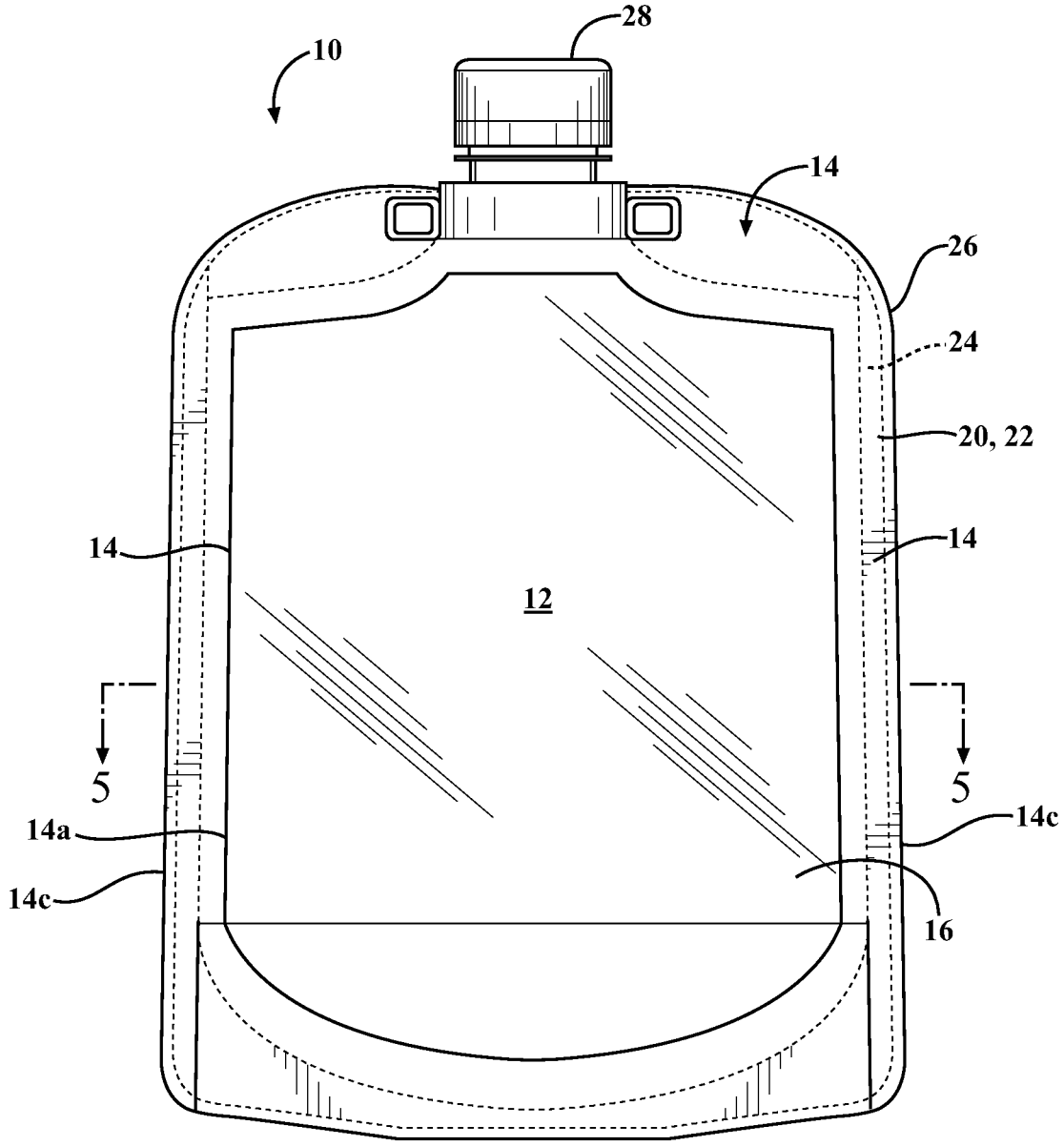
FIG. 4 is a frontal view of the pouch.
Figure 5:
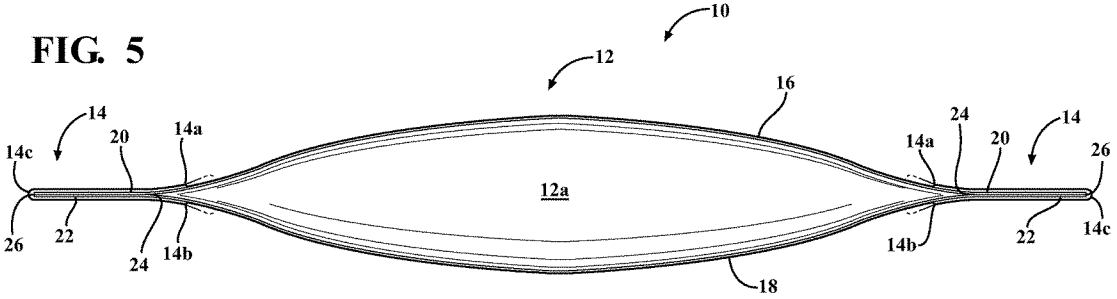
FIG. 5 is a view of FIG. 4 taken along lines 5-5.
Figure 6:
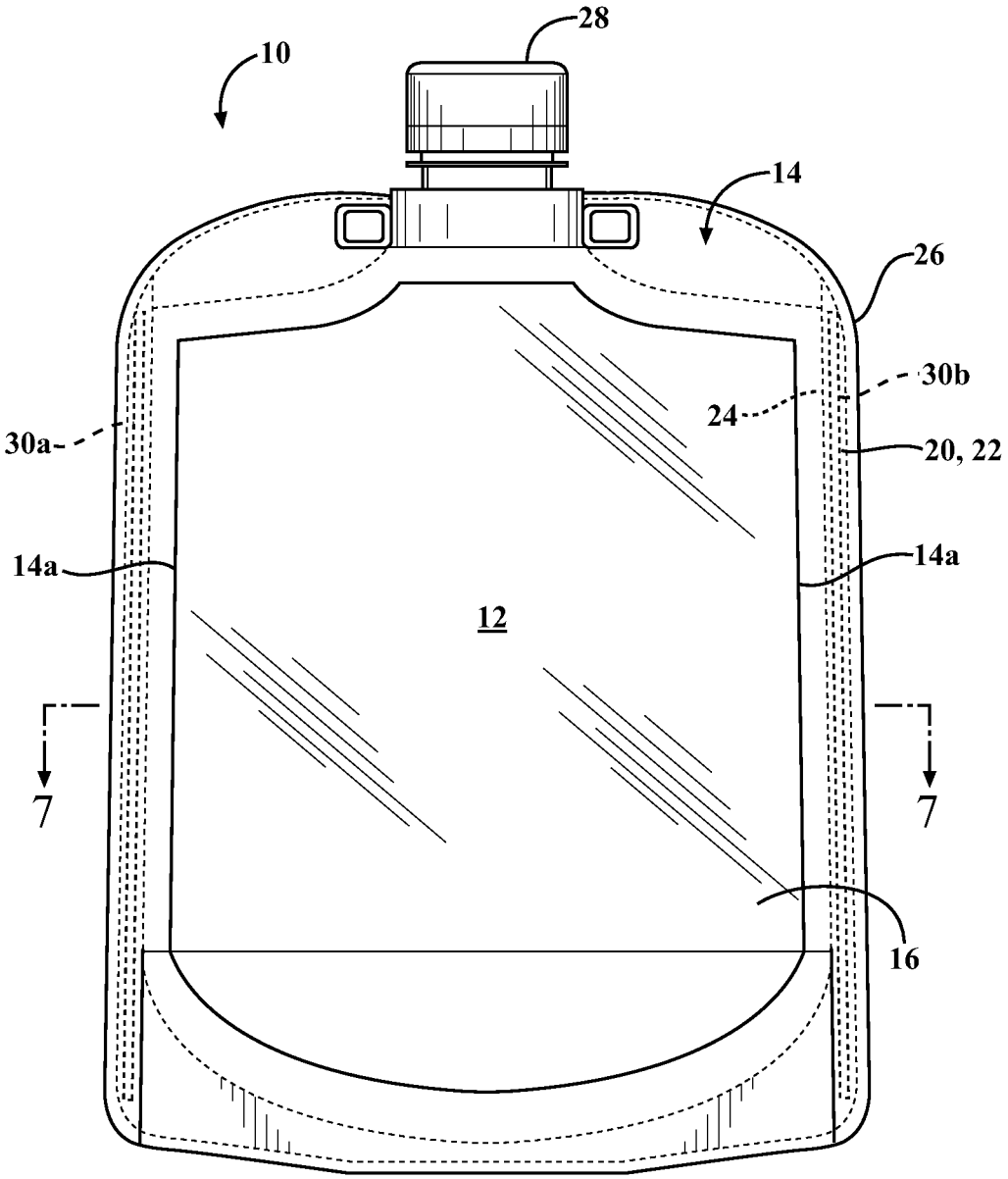
FIG. 6 is a perspective view of a self-standing pouch with an air channel on each side.
Figure 8:
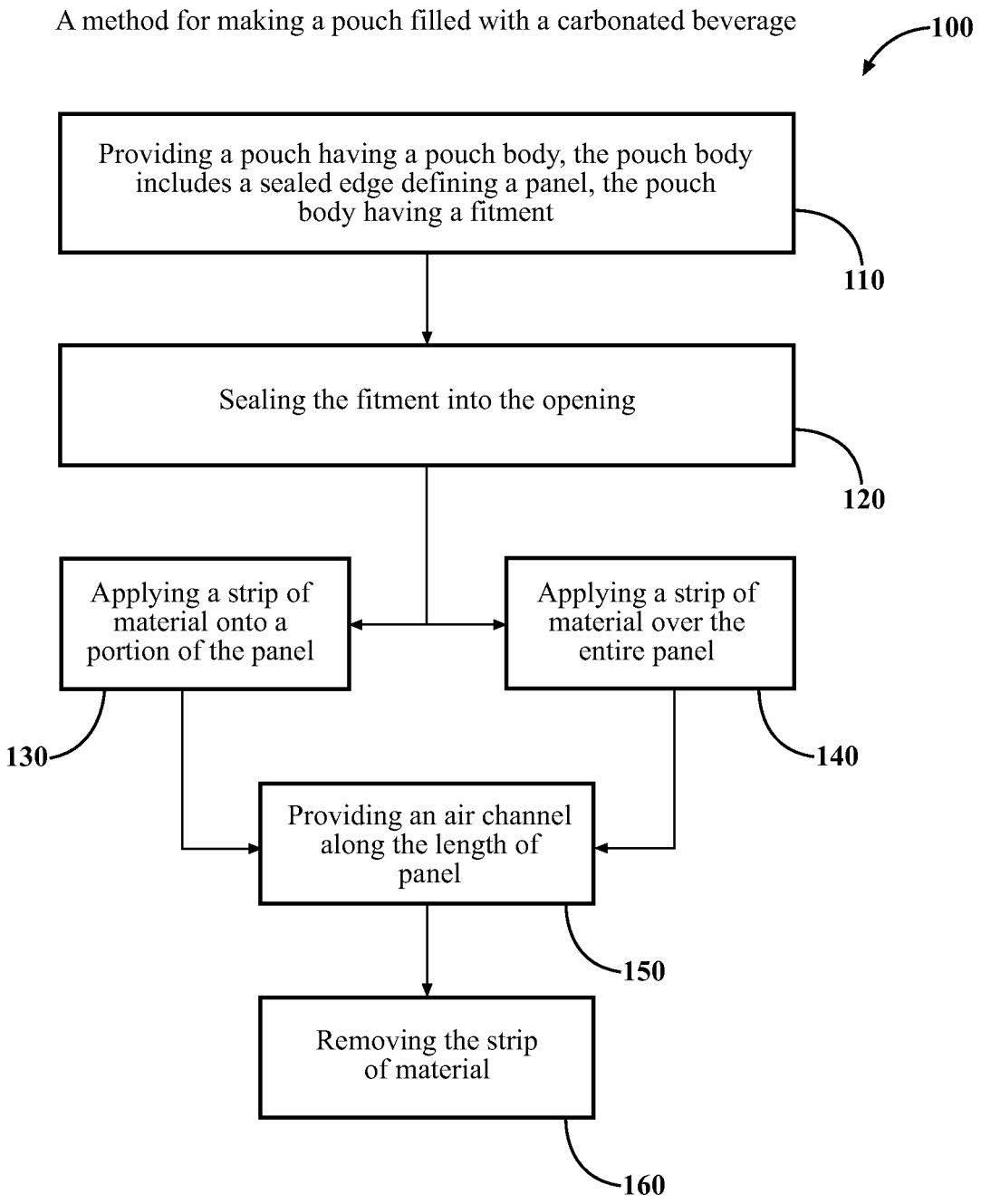
FIG. 8 is a diagram showing the steps of manufacturing a pouch filled with a carbonated beverage.

With reference again to FIG. 3 and now also to FIGS. 4-6, a description of the pouch 10 is provided. The pouch body 12 is further defined by a seal 20 formed by sealing the first and second sheet of laminate material 16, 18 together along an edge wherein the centers of the first and second sheet of laminate material 16, 18 are spaced apart from each other. The seal 20 may be form by sealing means currently known and used in the art, illustratively including heat sealing, vibrational welding, polymer fusion, and the like.

The seal 20 forms a panel 22 defining the peripheral edge of the pouch body 12. The panel 22 includes an inner peripheral edge 24 opposite an outer peripheral edge 26. The inner peripheral edge 24 is in fluid communication with the interior space 12*a* of the pouch body 12. The outer peripheral edge 26 is exposed to the environment.

The pouch 10 may be configured to provide access to the interior space 12*a* of the pouch body 12. As shown in FIGS. 3, 4 and 6, the pouch 10 may include a fitment 28 mounted to the top of the pouch body 12. However, it should be appreciated that the pouch 10 may include other means to provide access to the pouch body 12 currently known and used in the art, illustratively including a weakened portion (not shown) of the sheet of laminate material configured to be punctured by a sharpened straw. Further, it should be appreciated that the fitment 28 or the weakened portion may be located in various locations of the pouch body 12 and Figures are provided for illustrative purposes and are not limiting.

The pouch 10 further includes a strip 14. The strip 14 is mounted over the panel 22. The strip 14 has a width defined as the distance between opposite outer edges 14*a*, 14*b* of the strip. The first outer edge 14*a* is mounted on top of the front of the pouch 10 and the second outer edge 14*b* is mounted on top of the back of the pouch 10. The strip 14 is fixed to the pouch body 12 using various fixing techniques currently known and used in the art, illustratively including an adhesive, such as an acrylic adhesive configured for bonding at both low and high temperature applications (−30 degrees to 260 degrees Farenheit), ultrasound, heat treatment, and the like.

The strip 14 is formed of a pliable material providing flexibility generally commensurate with the flexibility of the pouch body 12. The strip 14 may be an aluminum composite, such a tape commonly referenced as duct tape. The strip 14 may have a thickness configured to provide sufficient rigidity to translate force from the inner peripheral edge 24 of the panel 22 to the outer edges of the strip 14. It should be appreciated that the strip 14 shown in FIG. 3 is provided for illustrative purposes. It is shown from the drawing that the strip 14 would only cover one side of the pouch body 12. However, it should be appreciated that the strip 14 may be dimensioned to cover the entire panel 22, and thus both sides of the pouch body 12, the bottom edge of the pouch body 12 and the top edge of the pouch body 12.

With reference now to FIG. 5, a cross-sectional view of FIG. 4 taken along line 5-5 is provided. FIG. 4 shows the strip 14 overlapping the inner peripheral edge 24 of the panel 22. The strip 14 is mounted over both the front and back of the pouch body 12 so as to form a fold 22*a*. The fold of the strip 14 is generally aligned with the outer peripheral edge 26 of the panel 22. In the event that the gases in the fluids within the pouch body 12 expand, stress from the expansion of the expansion are directed towards the outer edges of the strip 14 as indicated by the dashed lines showing the outer surface of the pouch body 12 bulging. Thus, pressure which is normally exerted on the seal 20 is directed away from the seal 20 towards to outer edges of the strip 14.

With reference now to FIG. 6 an illustrative view of a pouch 12 having a pair of air channels 30*a*, 30*b* is provided. The air channels 30*a*, 30*b* are disposed on the panel 22 forming opposite sides of the pouch body 12. Each of the air channels 30*a*, 30*b* bisect the axial length of the panel 22 so as to divide the panel 22 into equal halves. The air channels 30*a*, 30*b* are indicated by the hashed-dotted lines. The strip 14 covers the air channels 30*a*, 30*b* and extend towards the center of the pouch body 12 past the inner peripheral edge 24 of the panel as shown in FIG. 7.

A test was conducted using a pouch 10 having a pouch body 12, of the shape shown in FIG. 4, configured to hold approximately 500 ml of fluid. The panel 22 has a width of generally 6.35 mm. The panel 22 surrounds the pouch body 12. The strip 14 is an adhesive tape generally referenced as duct tape. The strip 14 has a thickness of 3 mm, and a width of generally 25.4 mm. Half of one side of the tape is mounted over the front portion of the pouch body 12, on top of the panel 22 and the other half of the tape is mounted over the back portion of the pouch body 12 on top of the panel 22. The pouch 10 was filled with a carbonated beverage, specifically beer. The pouch 10 was then heated and the gases in the beer expanded. The pouch body 12 expanded along the outer edges 14*a*, 14*b* of the tape as indicated in FIG. 5. Accordingly, stress was taken from the inner peripheral edge 24 of the seal 20, thus helping preserve the integrity of the seal 20.

Figure 7:
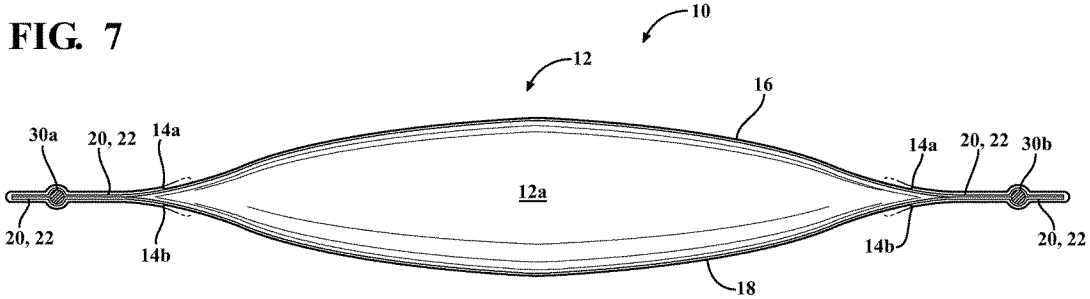
FIG. 7 is a view of FIG. 6 taken along lines 7-7.

With reference now to FIG. 7, a method 100 of making a pouch filled with a carbonated beverage is also provided. The method 100 includes step 110, providing a pouch 10 having a pouch body 12. The pouch body includes a sealed edge 20 with an opening for receiving a fitment 28. An illustrative example of a pouch is provided in FIGS. 3-6.

The method includes step 120, sealing the fitment 28 into the opening. The method includes step 130, applying a strip of material 14 onto the sealed edge 20. An illustration of a strip of material 14 for use in the method 100 is provided in FIG. 3. The edges of the pouch body 12 may be sealed along the peripheral edge of the pouch body 12 so as to form a panel 22 as shown in FIG. 3. The panel 22 includes an inner peripheral edge 24 opposite an outer peripheral edge 26. The inner peripheral edge 24 is in fluid communication with the pouch body 12. The outer peripheral edge 26 exposed to the environment.

The method may further step 140, applying a strip of material 14 over the entire panel 22, wherein the strip of material covers both sides of the panel, and wherein the strip of material extends towards the center of the pouch body, past the inner peripheral edge of the panel. The strip of material 14 has a width defined as the distance between opposite outer edges 14*a*, 14*b* of the strip. The first outer edge 14*a* is mounted on top of the front of the pouch 10 and the second outer edge 14*b* is mounted on top of the back of the pouch 10. The strip 14 is fixed to the pouch body 12 using various fixing techniques currently known and used in the art, illustratively including an adhesive, such as an acrylic adhesive configured for bonding at both low and high temperature applications (−30 degrees to 260 degrees Fahrenheit), ultrasound, heat treatment, and the like. The strip 14 may overlap the inner peripheral edge of the panel. The strip may be mounted over both the front and back of the pouch body so as to form a fold.

The method may further include step 150, providing an air channel along the panel, wherein the air channel is disposed along the sides of the pouch body and generally bisects the panel along its axial length. The method may further include step 160, wherein the strip of material is removed.

The foregoing drawings, discussion and description are illustrative of specific embodiments of the present invention, but they are not meant to be limitations upon the practice thereof. Numerous modifications and variations of the invention will be readily apparent to those of skill in the art in view of the teaching presented herein. It is the following claims, including all equivalents, which define the scope of the invention.

I claim:

1. A pouch; the pouch comprising:

a pouch body defined by a pair of sheets sealed together so as to form a panel having a first side opposite a second side, and an inner peripheral edge opposite an outer peripheral edge;

an outer layer formed of a sheet of material and folded over the outer peripheral edge of the panel, wherein a first portion of the outer layer mounted is mounted onto the first side of the panel and a second portion of the outer layer is mounted onto the second side of the panel, wherein the first portion of the outer layer extends away from the outer peripheral edge of the panel so as to place a first distal edge of the first portion beyond the inner peripheral edge of the panel and closer towards a center of the pouch body relative to the inner peripheral edge of the panel, and wherein the second portion of the outer layer extends away from the outer peripheral edge of the panel and beyond the inner peripheral edge of the panel towards the center of the pouch body so as to place a second distal edge of the second portion closer towards the center of the pouch body relative to the inner peripheral edge, the outer layer configured to displace stress from an inner peripheral edge of a seal; and a pair of air channels, the air channels are disposed between the inner peripheral edge and the outer peripheral edge on opposite sides of the pouch body.

2. The pouch of claim 1, wherein the panel defines a peripheral edge of the pouch body.

3. The pouch of claim 1, further including a fitment.

4. The pouch of claim 1, wherein the outer layer is a strip of material, the strip has a width defined as the distance between a first outer edge and a second outer edge of the strip, wherein the first outer edge mounted on top of a front of the pouch and the second outer edge is mounted on top of a back of the pouch.

5. The pouch of claim 4, wherein the strip is formed of a pliable material providing flexibility generally commensurate with the flexibility of the pouch body.

6. The pouch of claim 4, wherein the strip overlaps the inner peripheral edge of the panel.

7. The pouch of claim 1, wherein the outer layer is mounted over both the front and back of the pouch body so as to form a fold.

8. The pouch of claim 1, wherein each of the pair of air channels bisect an axial length of the panel, dividing the panel into halves of the panel.

* * * * *